US008191717B2

(12) United States Patent
Mantenuto et al.

(10) Patent No.: US 8,191,717 B2
(45) Date of Patent: Jun. 5, 2012

(54) SYSTEM FOR SAFELY TRANSPORTING LOADING AND UNLOADING SLABS

(75) Inventors: Paolo Mantenuto, Maple (CA); Peter T. De Kok, Atlanta, GA (US)

(73) Assignee: Simple Bundle Ltd., Concord, Ontario (CA)

( * ) Notice: Subject to any disclaimer, the term of this patent is extended or adjusted under 35 U.S.C. 154(b) by 0 days.

(21) Appl. No.: 12/799,242

(22) Filed: Apr. 21, 2010

(65) Prior Publication Data

US 2010/0206824 A1 Aug. 19, 2010

Related U.S. Application Data

(63) Continuation-in-part of application No. PCT/CA2008/000769, filed on May 23, 2008.

(51) Int. Cl.
*A47G 19/08* (2006.01)

(52) U.S. Cl. ..... 211/41.15

(58) Field of Classification Search ..... 211/41.1, 211/41.14, 41.15, 60.1, 70.4, 189, 191, 195, 211/200, 201, 202; 206/448, 335, 319
See application file for complete search history.

(56) References Cited

U.S. PATENT DOCUMENTS 297,485 A * 4/1884 Aycock ..... 34/143
1,738,516 A * 10/1927 Bloom ..... 211/202
1,730,777 A * 10/1929 Mayer ..... 280/144
2,466,149 A * 4/1949 Burg ..... 280/79.7
2,693,926 A 3/1954 Tatko
2,700,520 A * 1/1955 Skubic ..... 108/53.5
2,801,876 A * 8/1957 Palmer ..... 294/103.1
2,839,198 A 6/1958 Lefevre
2,990,070 A 6/1961 Cushman
3,147,860 A * 9/1964 Kean, Sr. et al. ..... 206/448
3,168,060 A * 2/1965 Farley ..... 108/53.5
3,193,093 A * 7/1965 Hansen ..... 206/451
3,240,505 A * 3/1966 Schlernitzauer ..... 280/651
3,301,405 A * 1/1967 Turney ..... 211/41.14
3,368,825 A 2/1968 De Voghel
3,405,665 A * 10/1968 Slonim ..... 108/55.1
3,420,379 A * 1/1969 Berryman ..... 211/1
3,493,128 A 2/1970 Silvert
3,540,614 A * 11/1970 Flagg ..... 220/4.28
3,568,608 A * 3/1971 Taylor et al. ..... 108/53.1
3,620,388 A * 11/1971 Mansson ..... 108/53.1
3,689,098 A * 9/1972 Rubin ..... 280/33.998
3,735,713 A * 5/1973 Glassmeyer ..... 108/53.5
3,762,580 A 10/1973 Melsek
3,802,357 A * 4/1974 Shahani ..... 108/53.5
3,844,600 A * 10/1974 Jay ..... 294/67.1
3,847,091 A 11/1974 Holt
3,861,662 A 1/1975 Morse
3,878,942 A * 4/1975 Hansen et al. ..... 206/454
3,887,078 A * 6/1975 Jay ..... 211/50
3,964,608 A * 6/1976 Rowley ..... 206/451
3,995,738 A * 12/1976 Rowley et al. ..... 206/451

(Continued)

*Primary Examiner* — Darnell Jayne
*Assistant Examiner* — Kimberley S Wright
(74) *Attorney, Agent, or Firm* — Rodgers & Rodgers

(57) ABSTRACT

A system including a collapsible, recyclable, cost-effective module for transporting, loading and unloading slabs or tiles. The module comprises two lateral U-shaped members with each U-shaped member defining a top portion, bottom portion, proximal arm and distal arm. The member bottom portions are attached to one another and corresponding releasable connectors close each U-shaped member. The module is attached to a stabilizing base which in turn is secured to a transport ship or vehicle. Multiple modules are interconnected for the purpose of stabilization.

12 Claims, 5 Drawing Sheets

U.S. PATENT DOCUMENTS 4,010,849 A * 3/1977 Pater et al. ..... 206/448
4,013,018 A 3/1977 Hansen et al.
4,320,836 A * 3/1982 Brown et al. ..... 206/451
4,360,298 A * 11/1982 Fischer et al. ..... 410/32
4,591,519 A 5/1986 Liebel
5,037,117 A * 8/1991 Hershberger ..... 280/79.7
5,145,073 A * 9/1992 Kitagawa et al. ..... 211/41.14
5,154,310 A * 10/1992 Massey ..... 206/505
5,379,904 A * 1/1995 Brown ..... 211/85.8
D357,102 S * 4/1995 Tate ..... D34/17
5,505,574 A * 4/1996 Piazza ..... 414/267
5,641,076 A * 6/1997 Englund ..... 211/41.14
5,647,708 A 7/1997 Letts, III
5,850,924 A * 12/1998 Borter ..... 211/41.14
5,860,539 A * 1/1999 Brown ..... 211/183
5,899,650 A 5/1999 Collins
6,062,781 A * 5/2000 Glaser ..... 410/100
6,123,208 A * 9/2000 Haenszel ..... 211/175
6,270,299 B1 * 8/2001 Rehbein ..... 410/41
6,322,303 B1 11/2001 John
6,343,555 B1 * 2/2002 Arai et al. ..... 108/53.5
6,394,267 B1 * 5/2002 Craig ..... 206/321
6,594,973 B1 7/2003 Alpert et al.
6,602,032 B2 * 8/2003 Arai ..... 410/46
6,626,304 B1 * 9/2003 Corbett et al. ..... 211/85.8
6,663,123 B1 12/2003 Kovacs
6,705,466 B2 * 3/2004 Bartholomew et al. ..... 206/454
6,769,848 B2 8/2004 Rostoker
6,789,688 B2 * 9/2004 Roush et al. ..... 211/201
7,128,510 B2 10/2006 Ahlert et al.
7,143,901 B1 12/2006 Groves
7,150,361 B2 * 12/2006 Calleja ..... 211/49.1
7,185,899 B2 * 3/2007 Thiede et al. ..... 280/47.35
7,240,791 B2 7/2007 Alpert et al.
7,264,126 B1 9/2007 Bergeron
7,270,236 B2 * 9/2007 Angeletti et al. ..... 206/448
7,328,907 B1 * 2/2008 Bileth ..... 280/79.11
D601,774 S * 10/2009 Segura ..... D34/35
7,704,024 B2 * 4/2010 Kootstra et al. ..... 410/44
7,802,526 B2 * 9/2010 Brady et al. ..... 108/53.5
2004/0232146 A1 * 11/2004 Kessler et al. ..... 220/6
2005/0205500 A1 * 9/2005 Yamamoto et al. ..... 211/41.14
2005/0249570 A1 11/2005 Deonarine
2006/0138067 A1 * 6/2006 Tourlamain ..... 211/195
2006/0169660 A1 * 8/2006 Winkler ..... 211/201
2006/0196838 A1 * 9/2006 Mercure et al. ..... 211/41.1
2007/0241013 A1 10/2007 Alpert et al.

* cited by examiner

SYSTEM FOR SAFELY TRANSPORTING LOADING AND UNLOADING SLABS

This is a continuation-in-part of international application PCT/CA2008/000769 with an international filing date of May 23, 2008.

BACKGROUND OF THE INVENTION

The present invention relates to a system for transporting, loading and unloading slabs and tiles, and more particularly, slabs or tiles of any of stone, granite, marble, mineral, glass, porcelain, plaster, polymer, wood, and precast cement or any like material of high density, low value which is normally transported in slab or sheet form.

In the past, transported slabs were unloaded and stored on open A-frames with the slabs held together by tension wrap. Removing or unloading slabs from A-frames is problematic as a vacuum is created when slabs are pulled apart, and pulling too quickly can cause other slabs to follow in succession. If control is lost, multiple slabs can fall over possibly breaking the slabs and/or endangering the workers. Unloading a conventional A-frame containing 20 industry standard granite slabs typically requires two hours and three men. Tension wraps are unsatisfactory because they weaken slab edge areas which sometimes can break away. Before shipping containers were developed, slabs, such as granite, had to be packaged very carefully on A-frames with heavy dunnage because slabs must be shipped on edge and granite is relatively heavy and very brittle, breaking easily in transportation. Also, A-frames consume warehouse resources inefficiently and loaded A-frames cannot be stacked top to bottom.

In the mid 50's, a trucker, Malcolm McLean, invented shipping containers. He revolutionized the shipping industry and was responsible for the original Sea-Land container ships which are now used globally. Using containers for transporting granite was an improvement on the earlier break bulk methodology and involves packaging up to 10 slabs ¾" thick in wooden packages called bundles with generally seven bundles loaded into a container. Traditional shipping containers are standardized at 20×8×8 feet and were designed for low density, high value cargo, but are not suitable for high density, low value cargo such as stone, which has a density of approximately 175-200 pounds per cubic feet. Twenty tons of stone are equivalent to 200-225 cubic feet of space which means that over 1,000 cubic feet or 80% of the container capacity goes unfilled. Also, stone or glass sheets are fragile and must be shipped upright, and because of the volume of wasted space, must be blocked and braced to prevent toppling and damage during transit. In heavy seas, nails will pull out and the bundles will fall apart. This loosening effect is dangerous to the laborers involved in stripping the container and when this happens, an entire container of stone worth perhaps $100,000 can be lost.

There is another drawback in that the wood used for packaging and dunnage must be fumigated for U.S. agricultural reasons and because the wood has, by definition, been chemically treated, it must then be disposed of professionally in HazMat sites. Finally, because of the volume of wood used for blocking and bracing, clearing a container takes extensive time, generally in excess of half a day employing four people.

There is also a safety drawback. On arrival at the destination, a laborer is sent into the container with a chainsaw to cut away the dunnage. If this is done carelessly, a bundle can topple pinning the laborer between the wall of the container and perhaps 10,000 pounds of stone. In the last 10 years or so, there have been no fewer than several hundred accidents, many of them fatal.

BRIEF SUMMARY OF THE INVENTION

The present invention provides a collapsible, recyclable, cost-effective module for transporting, loading and unloading slabs or tiles. The module inhibits slabs from falling over and does not require tension wraps. Both loading and unloading times are reduced, and warehouse resources are less stressed.

In one embodiment, two lateral U-shaped members respectively define a top portion, bottom portion, proximal arm and distal arm. The member bottom portions are attached to one another and there are corresponding releasable connectors to close each U-shaped member into an O-shape.

By this invention, the structure is metal rather than wood which can be disassembled and reused. Each module is self-supporting and stackable. Inside a container the modules can be clipped together to form a cohesive whole to prevent toppling, and each module is screwed and clipped to the floor of the container to prevent shifting.

On arrival at a destination, clearance is simple and quick, using two laborers for perhaps 45 minutes. There is no dunnage to be removed, no fumigated wood to be disposed of and no possibility of toppling. If shipped in an open top container, the modules can be lifted out of the container by an overhead crane or cherry picker. If a closed top container is used, the modules are unscrewed from the floor, the stability clips are removed and the modules are either removed with a special offset fork truck or simply dragged out on skids.

Once out of the container, the module is opened and, because the slabs have a 10° tilt, opening the module is totally safe as the center of gravity is always in the middle and relatively low. The slabs are lifted out one at a time using an Aardwolf or vacuum lifter. When the module is empty, it can be knocked down into six components strapped to a pallet and returned to the port of entry in the same container in which it arrived.

The modules weigh approximately 200 pounds per unit. A container will hold 40,000 pounds and, therefore, 210 empty modules can be loaded into one container. Seven fully loaded modules of granite or six fully loaded modules of engineered stone are used per container so 30 containers provide enough empty modules to fill another container for return to the port of origin.

The modules can also be transported over land on a flatbed or high-sided truck using a specialized loading rack/receptacle. Fully loaded units weighing a total of 40,000 pounds can be transported easily, quickly and safely. The stabilizing base prevents shifting at the base and chains and security clips prevent toppling. As they are all at the front of the truck instead of the back, there is little chance of swaying or fish-tailing.

DETAILED DESCRIPTION OF THE INVENTION

Figure 1:
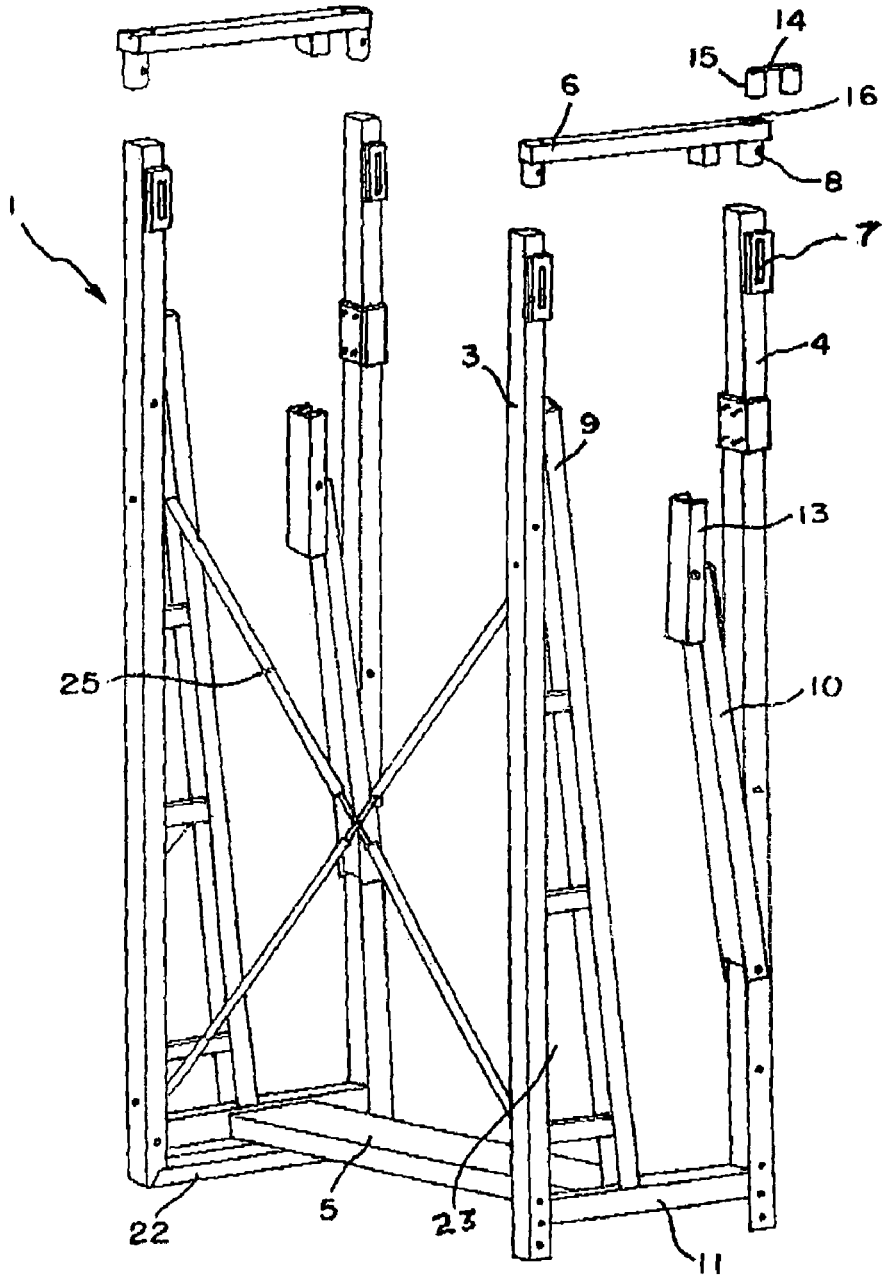
FIG. 1 is an exploded perspective view of the module, according to this invention.

FIG. 1 depicts one embodiment of the present invention, including a skeletal module for slabs generally designated by the numeral 1. Module 1 is preferably metal, but can be constructed of any material suitable for transporting, loading and unloading slabs 2 which include stone, granite, marble, glass, porcelain, plaster, polymer, mineral, wood and pre-cast cement. The various comments of module 1 are suitably connected together by conventional fasteners, such as screws, nuts and bolts, as is well known.

Module 1 is a parallelepiped including two lateral U-shaped members, each member defining a top portion, bottom portion, proximal arm 3 and distal arm 4. "U-shaped" means not only shaped as a letter U, but includes H-shaped, anything between U and H with respect to a horizontal line joining two vertical lines, the horizontal line being disposed toward a bottom portion of each vertical line. The bottom portions of each of the first and second U-shaped members are connected to each other by means of detachable joining member 5 and releasable from each other to permit module 1 to be collapsed for transport and recycling.

Two corresponding releasable connectors 6 are provided to close each of the U-shaped members at or near the member top portions into an O-shape enclosure through which slabs 2 will pass. "O-shape" means any shape from ovoid to circular to letter O to zero to right angle polygon, so long as the shape remains functional. The proximal 3 and distal 4 arms define cooperative engagements 7 for attachment to a crane by means of lifting means shown in FIG. 7 to facilitate transport. Releasable connectors 6 also include downwardly extending engagements 8 for coupling to proximal arm 3 and distal arm 4. Connectors 6 are attached to proximal arm 3 and distal arm 4 in known manner by means of screws and the like.

When the connectors 6 are disconnected and released upwardly, slabs 2 can be safely and quickly loaded and unloaded and, when connected, slabs 2 can be safely and quickly transported. An incline 9, disposed toward and secured to proximal arms 3 is provided to transport, load and unload slabs 2 thusly inclined and incline 9 is cushioned as desired.

Figure 2:
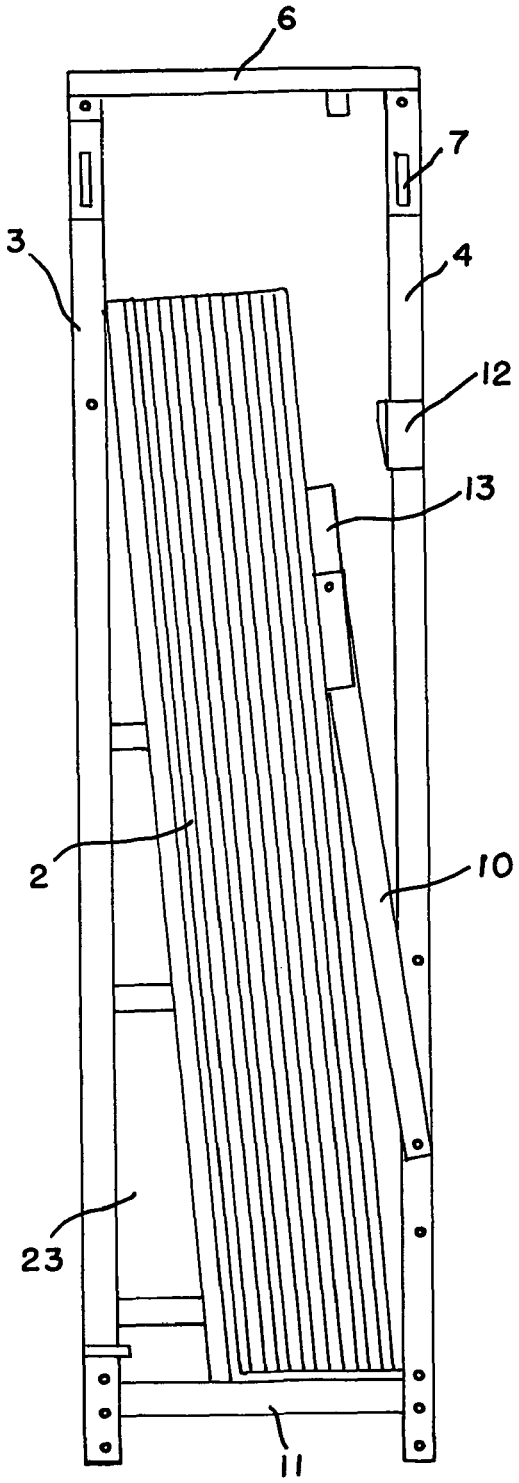
FIG. 2 is a side view of the module.

Further safety in transport is achieved by inserting a shim, regardless of whether an incline 9 is provided. The shim is shown as a pair of moveable stabilizing arms 10 disposed respectively away from the distal arms 4. A stabilizing arm 10 is attached to each distal arm 4, crossbar 11 or connector 6, so long as slabs 2 can be placed in between the proximal arms 3 and the stabilizing arms 10. In the embodiment shown in FIG. 1, stabilizing arm 10 is pivotally connected to distal arm 4. Gravity sleeve lock 12 (FIG. 2) is slidably attached to distal arm 4 and, when a stabilizing arm 10 engages slabs 2, lock 12 is lowered to engage and lock stabilizing arm 10 against slabs 2. Stabilizing arm 10 includes oblique support 13, suitably positioned to engage and further stabilize slabs 2.

Due to the inherent instability of modules 1 when they are placed individually into a shipping container, it is necessary to stabilize modules 1 in the absence of which undesirable movement of modules 1 is likely to occur due to the heavy weight of combined slabs 2 contained in module 1. As best shown in FIG. 1, stabilization is provided at the top of modules 1 in the form of stabilizing clips 14 which include spaced downwardly extending stabilizing tabs 15 which are adaptable to fit within spaced apertures 16 formed in the top of connectors 6.

Figure 3:
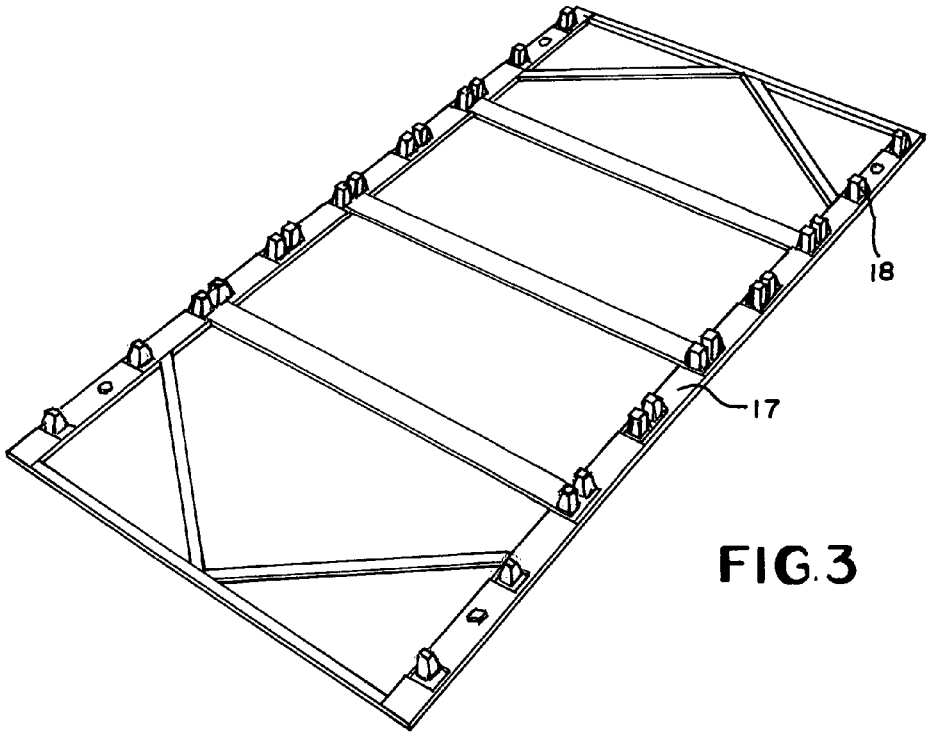
FIG. 3 is a perspective view of the system stabilizing base.

Stabilization at the bottom of module 1 in one form, as shown in FIG. 3, is provided in the form of stabilizing base 17 with multiple stabilizing lugs 18 upstanding therefrom. Stabilizing lugs 18 are generally square in cross-section and are inwardly tapered upwardly from stabilizing base 17

In order to prepare a shipping container for the transport of granite or other like slabs, a fully loaded module 1 is maneuvered into the shipping container by a forklift or other suitable means. The bottom of module 1 is then secured in place by suitable attachment means, such as screws, interconnected to the container and, if desired, further secured by tying module 1 down by means of cables attached to the sides of the container. Additional modules 1 are successively loaded into the shipping container and similarly secured in position.

To fully secure modules 1 in position, stabilizing clip 14 is utilized to interconnect the upper portions of adjacent modules 1 so that one stabilizing tab 15 of stabilizing clip 14 is inserted into aperture 16 associated with one module 1 with the opposite stabilizing tab 15 placed in the corresponding aperture 16 of the adjacent module 1. Modules 1 disposed side-by-side are then fully secured at both the upper and lower portions.

Figure 4:
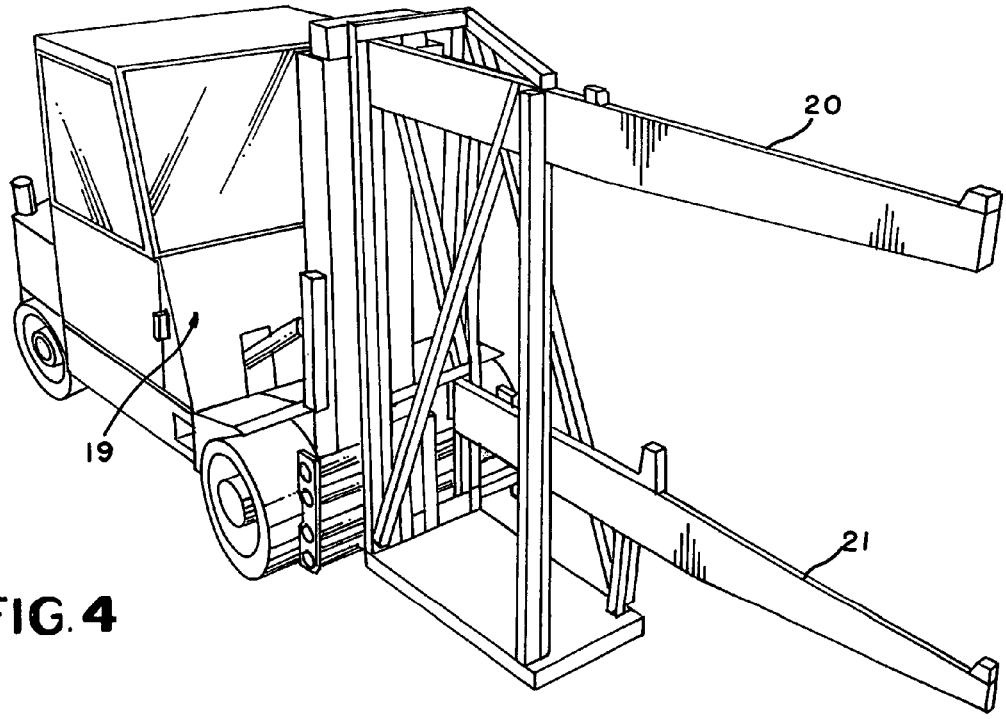
FIG. 4 is a perspective view of a forklift truck modified in accordance with this invention.

When the shipping container arrives at the point of destination, it is lifted out of the shipping container by a crane. Modules 1 are removed from a shipping container by sliding them on skid 22. If it is desired to transport modules 1 a short distance by ground, as shown in FIG. 4, forklift 19 is utilized which has vertically spaced and horizontally offset arms 20 and 21 whereby arm 20 is inserted under connectors 6 which interconnect proximal arms 3 and distal arms 4 and arm 21 is inserted through openings 23 formed between proximal arms 3 and incline 9 of module 1.

Figure 5:
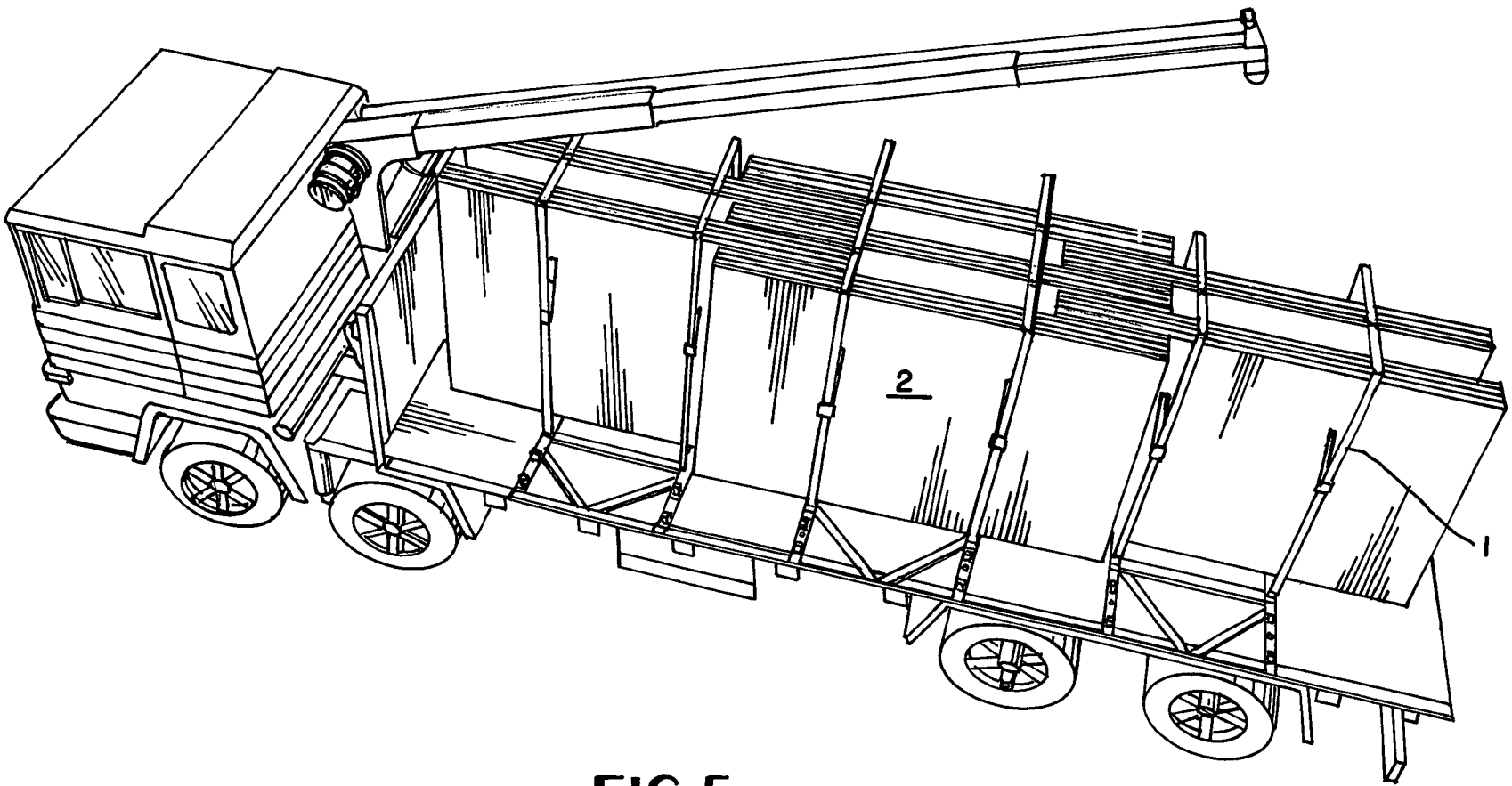
FIG. 5 is a perspective view of a loaded ground transport vehicle.

Typically, modules 1 are shipped from the port of entry to a distant location by means of a flatbed truck with an attached crane, as shown in FIG. 5. Since it would be highly dangerous to transport modules 1 on a flatbed truck in an unsecured condition, multiple stabilizing bases 17 are secured to the truck bed. Multiple modules 1 are loaded onto the truck by crane whereby the hollow openings at the bottoms of proximal and distal arms 3 and 4 are positioned on stabilizing lugs 18 and adjacent modules 1 are secured at their upper portions by means of stabilizing clips 14. Since stabilizing lugs 18 are upwardly tapered, arms 3 and 4 self-align as they are lowered onto stabilizing lugs 18. Due to length limitations of the truck, modules 1 are positioned so that slabs 2 overlap, as shown in FIG. 5.

Figure 6:
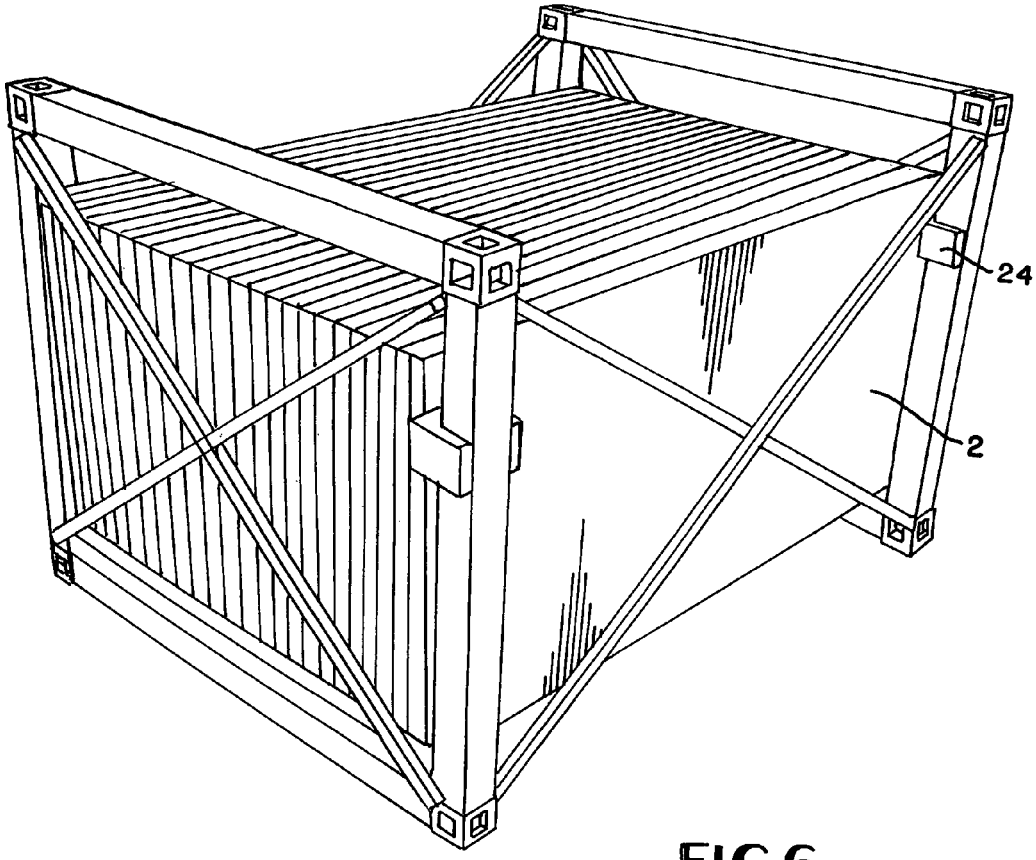
FIG. 6 is a perspective view of a modification of the system.

By this invention, modified modules, as shown in FIG. 6, are adaptable for shipment by sea other than in conventional shipping containers. This is accomplished by attaching multiple stabilizing bases 17 to the deck of a transport ship and then securing multiple modules thereto by lowering them into engagement with stabilizing lugs 18 in the same manner as with a flatbed truck. Also, shipping in this manner allows multiple modules, shown in FIG. 6, to be stacked vertically by cooperative interlocking engagement of the upper ends of arms 3 and 4 of one module with the lower ends of arms 3 and 4 of the module disposed thereabove. Also, as viewed in FIG. 6, an increased number of slabs 2 can be transported by essentially expanding the module laterally. In this bulk transport version of the module, stabilizing blocks 24 provide tension against angularly disposed slabs 2.

After slabs 2 have been removed from module 1 at the final destination, modules 1 are collapsed for return to a port of origin. This is accomplished by removing upper connectors 6 and lower joining member 5 from module 1 and then moving the two U-shaped members toward each other whereby crossbar support 25 is collapsed. Multiple collapsed modules 1 are then bundled and stacked together for placement in a shipping container for the return trip.

Figure 7:
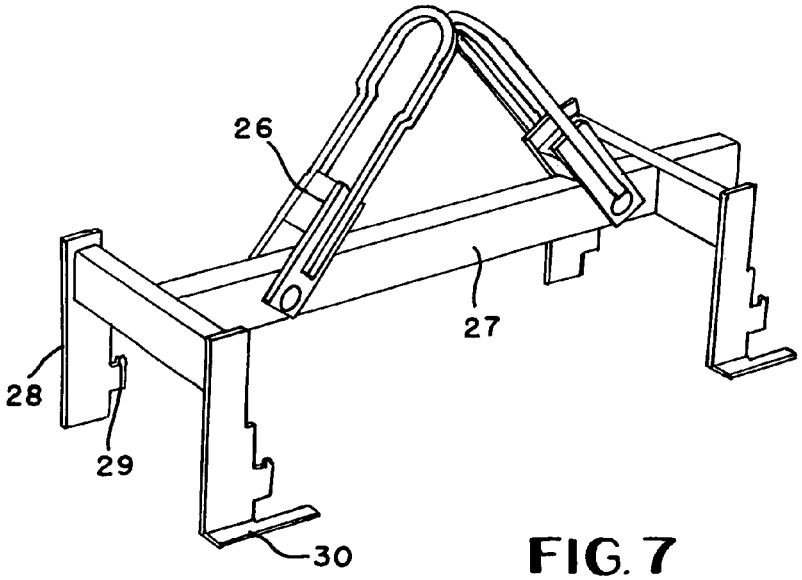
FIG. 7 is a perspective view of the module lifting device.

In order to move modules 1 to or from a shipping container or other mode of transportation, and as shown in FIG. 7, crane lifting attachment 26 is utilized and is attached to frame 27 which includes four downwardly projecting attachment bars 28. Each attachment bar 28 includes a coplanar hook 29. Struts 30 extend outwardly from the lower ends of attachment bars 28 disposed on one side of frame 27 and are disposed perpendicular thereto. Therefore, when the device is lowered by the cooperation with attachment 26 and a conventional crane, hooks 29 are inserted, respectively, into a locking relationship with cooperative engagements 7 of module 1 and by which struts 30 are disposed in an abutting relationship with the associated proximal arm 3 or distal arm 4. More specifically, hook 29 is inserted into an aperture formed in cooperative engagement 7 which is in the form of an enclosure protruding outwardly from each arm 3 and 4. Module 1 is then lifted and transferred to the desired location after which frame 27 is disengaged from module 1.

Specific embodiments of the present invention have been described to illustrate only the manner in which the invention is made and used. Implementation of variations and modifications will be apparent to one skilled in the art, and this invention is not limited by the embodiments illustrated. The present invention includes modifications, variations and equivalents that fall within the spirit and scope of the underlying principles disclosed and claimed herein.

The invention claimed is:

1. A module for transporting slabs comprising two lateral U-shaped members, each defining a top portion, bottom portion, proximal arm, and distal arm, the bottom portions being attached to one another, a first set of releasable connectors to close each U-shaped member of said module, an incline disposed toward one of said arms, tensioning means to urge said slabs toward said incline, said tensioning means comprising a stabilizing arm disposed away from one of said arms, said stabilizing arm being pivotally connected to the other of said arms, a planar oblique support being pivotally attached to said stabilizing arm and positioned to engage the adjacent one of said slabs in a flat face contacting condition, said first set of releasable connectors respectively having oppositely disposed ends, apertures formed in said first set of connectors respectively said ends and extending downwardly, a second module for transporting slabs positioned adjacent said module, said second module comprising two lateral U-shaped members, a second set of releasable connectors to close each U-shaped member of said second module, said second set of releasable connectors respectively having oppositely disposed ends, apertures formed in said second set of connectors respectively adjacent said ends and extending downwardly, a stabilizing clip having spaced downwardly extending stabilizing tabs, one of said stabilizing tabs disposed in one aperture of said first set of releasable connectors, and the other of said stabilizing tabs disposed in the adjacent aperture of said second set of releasable connectors.

2. The module according to claim 1 wherein a lock cooperatively engages said stabilizing arm.

3. The module according to claim 1 wherein said incline is disposed toward said proximal arm and said stabilizing arm is pivotally connected to said distal arm.

4. The module according to claim 1 wherein said slabs are any one selected from a group of stone, granite, marble, glass, mineral, porcelain, plaster, polymer, precast cement and wood.

5. The module according to claim 2 wherein said lock cooperatively engages said distal arm.

6. The module according to claim 1 wherein said member top portions of the U-shaped member define cooperative engagements for attachment to a laterally disposed module.

7. The module according to claim 1 wherein said member bottom portions of the U-shaped member define engagements for attachment to a stabilizing base.

8. The module according to claim 1 wherein each of said arms comprises a bottom and the bottoms of said arms are hollow to facilitate stacking.

9. The module according to claim 1 wherein said module is collapsible.

10. The module according to claim 1 wherein said bottom portions are releasably attached to each other.

11. The module according to claim 1 wherein cooperative engagements are secured to the upper portions of said proximal and distal arms and said cooperative engagements comprise an enclosure with an aperture formed therein opposite said arms.

12. The module according to claim 9 wherein said U-shaped members are interconnected by means of a crossbar support and said crossbar support is pivotable midway between said U-shaped members.

* * * * *